United States Patent [19]

LaFrasse et al.

[11] Patent Number: 4,938,048

[45] Date of Patent: Jul. 3, 1990

[54] GUIDE STRIP CONTROL DEVICE OF PIPE BENDING MACHINE

[75] Inventors: Jean LaFrasse, Dardilly; Jean-Paul Chastan, Ecully, both of France

[73] Assignee: Picot, S.A., Tassin La Demi Lune, France

[21] Appl. No.: 278,962

[22] Filed: Dec. 2, 1988

[30] Foreign Application Priority Data

Dec. 2, 1987 [FR] France ..... 87 17184

[51] Int. Cl.[5] ..... B21D 7/04; B21D 9/05

[52] U.S. Cl. ..... 72/154

[58] Field of Search ..... 72/149, 154, 155, 157, 72/158, 159

[56] References Cited

U.S. PATENT DOCUMENTS

| | | | |
|---|---|---|---|
| 3,287,952 | 11/1966 | Van Harten | 72/150 |
| 3,410,125 | 11/1968 | Schmidt | 72/156 |
| 3,553,990 | 1/1971 | Suding et al. | 72/8 |
| 4,126,030 | 11/1978 | Zollweg et al. | 72/154 |
| 4,130,004 | 12/1978 | Eaton | 72/154 X |

*Primary Examiner*—E. Michael Combs

*Attorney, Agent, or Firm*—Browdy and Neimark

[57] ABSTRACT

A guide strip control device of pipe bending machine for controlling the transverse movement of a guide strip that is applied laterally against a pipe to be bent, which is held and moved longitudinally by a carriage. A first cylinder moves the guide strip over a considerable distance to disengage the pipe entirely from its gripping position and thus to allow the free passage of the carriage. A second cylinder moves the guide strip over a short distance so that the pipe is freed laterally but remains supported by a part of the guide strip.

5 Claims, 2 Drawing Sheets

GUIDE STRIP CONTROL DEVICE OF PIPE BENDING MACHINE

BACKGROUND OF THE INVENTION

1. Field of the Invention

The present invention relates to machines intended for bending pipes and relates more particularly to a guide strip control device of a pipe bending machine.

2. Prior Art

In such a machine, the bending tool usually comprises: a rotary shaping roller, with a vertical axis, exhibiting on its periphery an annular groove and supporting a first jaw, a second jaw carried by a bending arm mounted to pivot around said vertical axis, the second jaw working with the first jaw to grip and carry the pipe to be bent, and a horizontal guide strip, parallel to the unbent part of the pipe, located behind the jaws and provided to be applied laterally against the pipe to be bent.

Thus, to achieve a bend in a part of the pipe, this part is gripped between the two jaws and carried forward by rotation of the bending arm, to be wound in the groove of the shaping roller. The angle of rotation of the arm determines the bending angle, and the radius of the shaping roller determines the radius of the bend formed in the pipe. The guide strip applied laterally against the pipe behind the part being bent avoids any undesired deformation of the pipe outside the part to be bent, and transmits to the machine frame the forces developed in the pipe during bending.

The guide strip can move relative to the frame, transverse to the initial direction of the pipe to be bent, to release this pipe to allow its introduction, its advance and its withdrawal. In some machines, this guide strip can, in addition, be moved longitudinally to follow the advance of the pipe during bending.

In pipe bending machines with automatic operation, the pipe to be bent is gripped in its straight part by a gripping chuck carried by a carriage that can be moved in the longitudinal direction. The carriage controls the advance of the pipe and assures, in its stop positions, the positioning of the pipe relative to the bending tool, for making the successive bends in this pipe.

When the carriage comes close to the bending tool, the guide strip, by its presence, constitutes an obstacle to the passage of the carriage, and must be retracted laterally. There is no drawback there, because the pipe is held by the grip of the carriage in its part close to the bending tool.

On the other hand, when the carriage is distant from the bending tool, the pipe has a part of considerable length which, when the guide strip is away from it, is no longer supported by this guide strip, and juts out. Then to support the straight part of the pipe, it is necessary to resort to devices. For this purpose, mobile supports are especially provided distributed over the length of the machine frame and controlled either mechanically by the advance of the carriage or by pneumatic or other means; these supports, upholding the pipe at several points, retract one after the other as the carriage advances.

Such a unit of supports, with their control means, constitutes a complicated, expensive and inefficient device; in particular, adjustment of the device is inconvenient because it requires an intervention on each of the supports.

SUMMARY OF THE INVENTION

The present invention aims at avoiding these drawbacks by providing a pipe support device that is simple, compact, efficient and easy to use, the proposed device eliminating all the supports mentioned above, while solving the problem posed by the arrival of the carriage interfering with the guide strip.

For this purpose, the invention has at its object a guide strip control device of a pipe bending machine of the type considered here, which comprises, for the control of the movement of the guide strip transverse to the initial direction of the pipe to be bent, first means to move this guide strip over a relatively long distance to disengage the pipe entirely from its gripping position and thus to allow free passage of the carriage and second means distinct from the first means to move said guide strip over a relatively short distance so that the pipe is freed laterally but remains supported by a part of the guide strip.

Thus, by a suitable control, the guide strip itself provides the support of the pipe to be bent as long as the carriage is distant from the bending tool. Only when the carriage interferes with the guide strip is the latter moved away enough to disengage the pipe entirely and allow passage of the carriage.

According to a preferred embodiment of the invention, the means to move the guide strip over a relatively long distance consist of a first cylinder, and means to move the guide strip a relatively short distance consist of a second cylinder, the two cylinders being mounted in series with one another and being controlled independently of one another.

In a particular embodiment, the first cylinder, moving a relatively long distance, connects the guide strip support, which is mounted to slide on guide means carried by the machine frame, to the piston of the second cylinder, moving a relatively short distance, whose body is fastened to the machine frame. When the second cylinder is operated, the guide strip is thus moved over a short distance by the first cylinder which, not being operated, then acts simply as a transmission rod.

The device also advantageously comprises means for manual adjustment of the relative axial position of the first cylinder and of the piston of the second cylinder. The adjustment means can take the form of an adjusting screw, mounted to turn freely in the piston of the second cylinder along the axis of the latter and connected to a wheel or crank, the screw working, by its thread, with a tapped sleeve mounted to slide in the axial direction of the piston of the second cylinder but immobilized in rotation, and fastened to one end of the first cylinder. Thanks to this adjustment means, it becomes possible to compensate for the possible differences in thickness of the guide strip, without disturbing the operation of the two cylinders.

BRIEF DESCRIPTION OF THE DRAWINGS

In any case, the invention will be better understood with the help of the following description, with reference to the diagrammatic drawing representing, by way of nonlimiting example, an embodiment of this guide strip control device of a pipe bending machine, and illustrating its operation, in which.

DETAILED DESCRIPTION OF THE INVENTION

Figure 1:
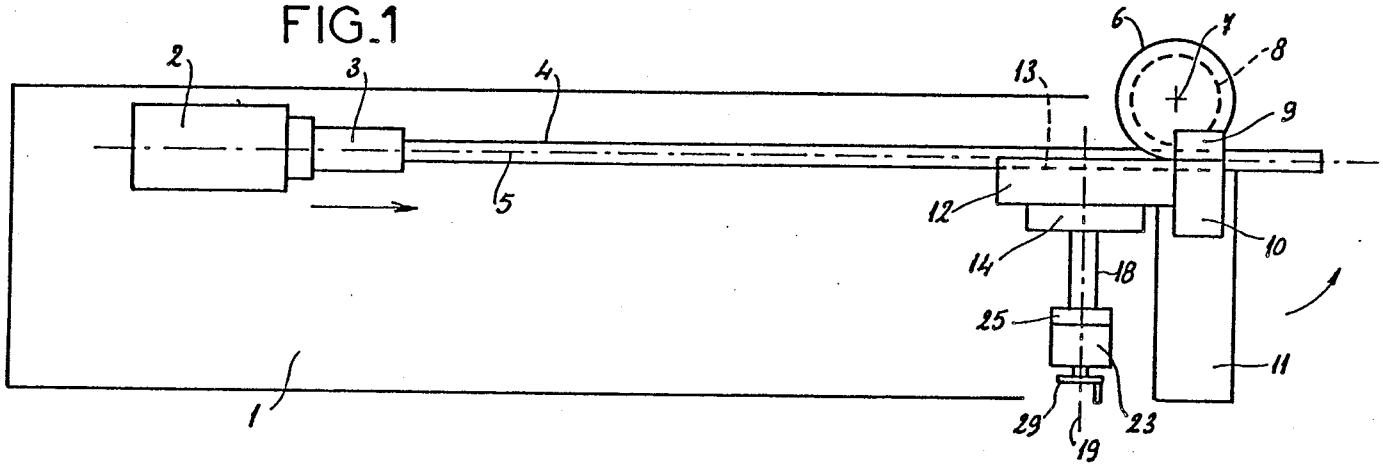
FIG. 1 is a very diagrammatic plane top view of a pipe bending machine with a guide strip controlled by the device according to the invention, the guide strip being mounted here in the position of gripping the pipe to be bent.
Figure 2:
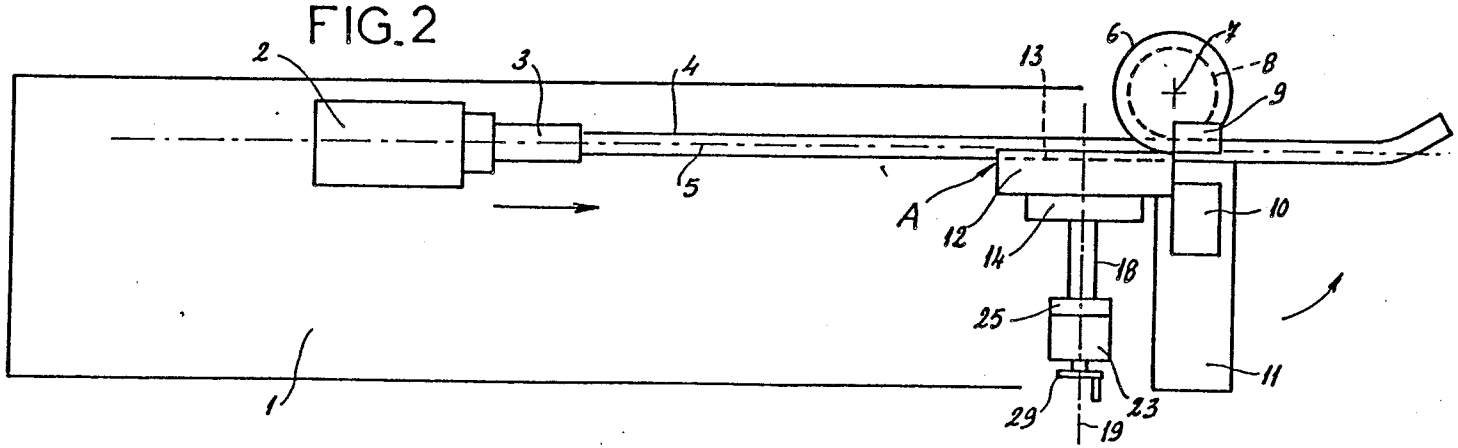
FIG. 2 is a view similar to FIG. 1, but showing the guide strip in a position slightly removed from the pipe.
Figure 3:
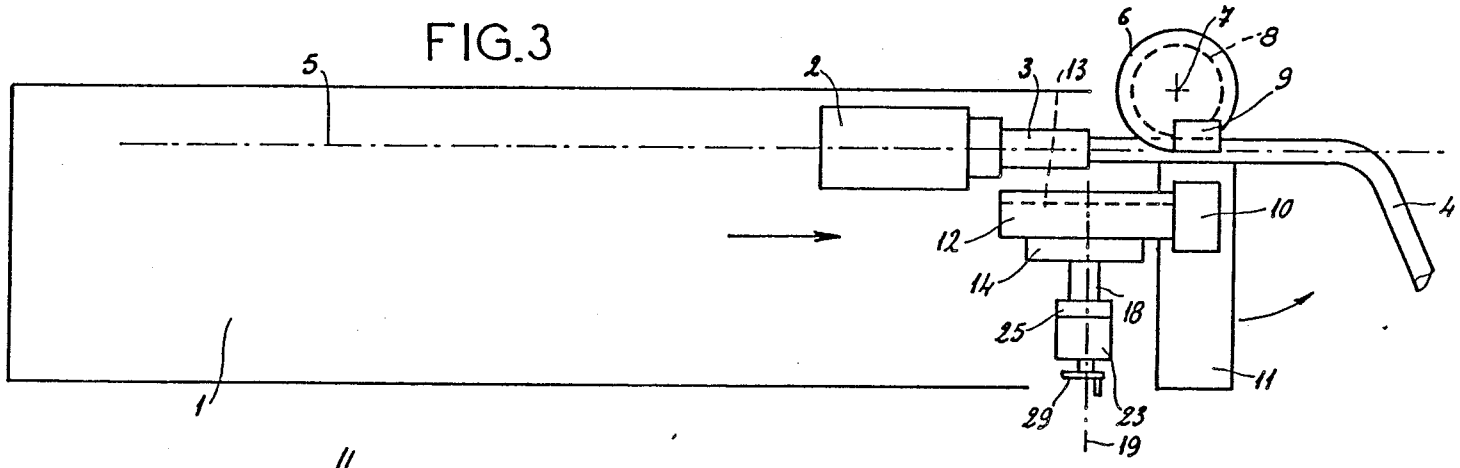
FIG. 3 is a view similar to the two preceding figures, showing the guide strip moved to allow the free passage of the carriage.

The pipe bending machine, represented in the drawing and more particularly in FIGS. 1 to 3, comprises an elongated frame 1 which supports longitudinal guides along which carriage 2 can be moved. Carriage 2 comprises a gripping chuck 3, able to grip pipe 4 to be bent, holding it along a horizontal axis 5; carriage 2 not only allows the advance of pipe 4 along axis 5 but also the rotation of this pipe 4 around said axis 5.

At the front of frame 1 of the machine is provided a bending tool which comprises mainly: a shaping roller 6 having a vertical axis 7 and exhibiting on its periphery an annular groove 8 and supporting a first jaw 9, a second jaw 10 carried by a bending arm 11 mounted to pivot about vertical axis 7, and a guide strip 12 extending parallel to axis 5 of pipe 4 to be bent and exhibiting a longitudinal groove 13.

Carriage 2 makes it possible to bring the part of pipe 4 which is to be bent to the level of the tool described above. This part of pipe 4 is gripped between the two jaws 9 and 10, and bending arm 11 is driven in rotation around vertical axis 7, at a predetermined angle, to wind the desired part of pipe 4 around shape roller 6, engaging it in annular groove 8 of roller 6.

During the bending operation, guide strip 12 should be applied laterally against pipe 4, just behind the part to be bent to balance the force generated by the bending torque. Locked against pipe 4 during bending, this guide strip 12 obviously should be removed from pipe 4 to allow the introduction of this pipe 4, its advance along axis 5, and its withdrawal. For this purpose, a control device is provided which moves guide strip 12 in a horizontal plane, in a direction transverse to the initial direction of pipe 4 to be bent, in other words, a direction perpendicular to axis 5 of this pipe 4. This present invention relates precisely to the structure of this control device of guide strip 12, which appears in detail in FIG. 4.

Guide strip 12 is carried by support 14, itself mounted on a mobile horizontal slide 15 which slides on a stationary slide 16 mounted on machine frame 1, as indicated by arrow 17.

A first control cylinder 18, placed along a horizontal axis 19 perpendicular to axis 5 of pipe 4 to be bent, has a body 20 connected to support 14 of guide strip 12. Rod 21 of this first cylinder 18 is connected axially to piston 22 of second control cylinder 23, whose body 24 is fastened to frame 1 by a support 25.

First cylinder 18, fed pressurized fluid 26, moves a relatively long distance, which will be specified below in describing the operation of the machine. Second cylinder 23 moves a slight distance, for example a few millimeters, which is designated by C and whose role will also be explained below. The latter cylinder 23 is fed pressurized fluid at two points independently of first cylinder 18, as indicated respective arrows 27 and 28 for control of its two movements, namely, advance and recoil over distance C.

Figure 4:
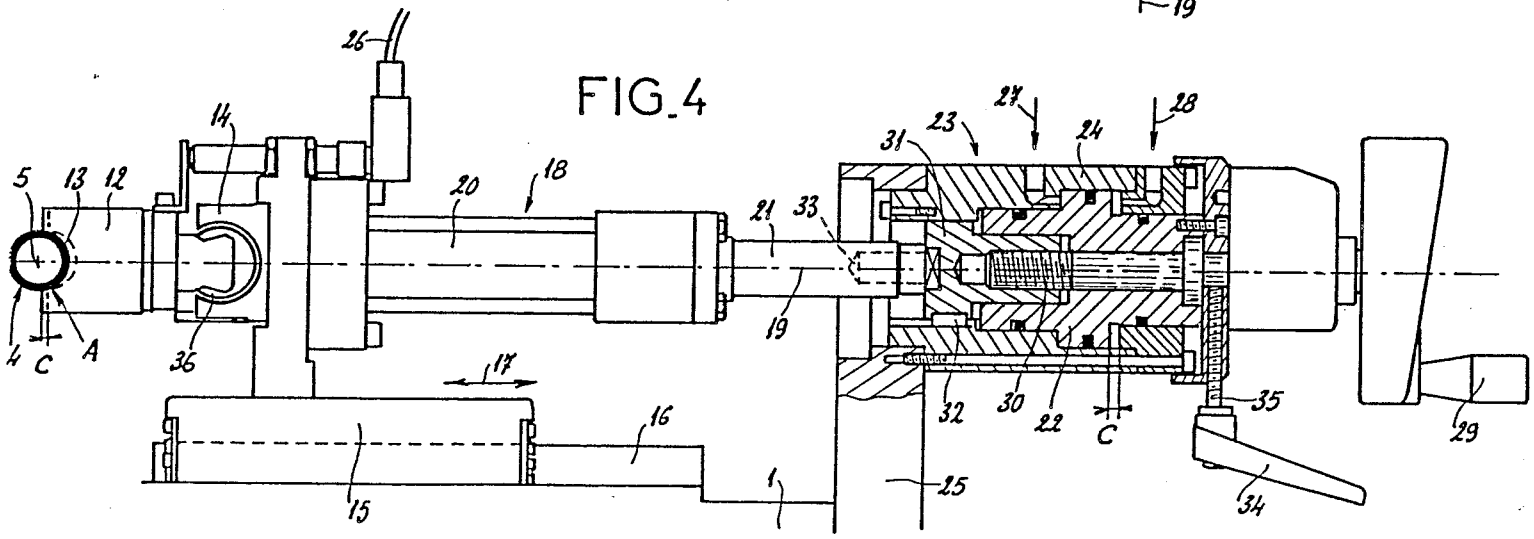
FIG. 4 is a detail view, with partial longitudinal section, of the guide strip control device.

The device shown in FIG. 4 also comprises manual adjustment means, with an outside crank 29 solidly connected with an adjusting screw 30, mounted to turn in piston 22 of second cylinder 23, along axis 19 of this cylinder. Adjusting screw 30 has a smooth part mounted free in rotation in piston 22 but connected axially to this piston 22. The thread of screw 30 is screwed in a tapped sleeve 31, housed partially in a control recess of piston 22. Sleeve 31 itself is mounted to slide relative to body 24 and to piston 22 of cylinder 23. A key 32 prevents the rotation of sleeve 31 relative to body 24 of cylinder 23. A connecting element, such as a screw 33, makes sleeve 31 solid with the outside end of rod 21 of first cylinder 18. A control lever 34 solid with a pressure screw 35 is also provided, which can rest laterally on adjusting screw 30 to block rotation thereof.

During operation of the bending machine, and more particularly in the case of making several bends distributed over the length of pipe 4, guide strip 12 is operated as follows by the device described above.

As long as carriage 2 is away from the bending tool, guide strip 12 is only slightly removed from pipe 4 to allow the advance of the latter between two successive bending operations. For this purpose, only second cylinder 23 is operated, and this cylinder 23 moves guide strip 12 by first cylinder 18 which then intervenes only as a simple transmission rod. Because of the short distance C traveled by second cylinder 23, guide strip 12 releases pipe 4 while leaving it partially engaged in longitudinal groove 13 of this guide strip 12, as shown in FIG. 2 and the mixed line of FIG. 4 (on the left). Pipe 4 thus remains supported by a part of guide strip 12, as indicated at A.

When carriage 2 comes close to bending tool and interferes with guide strip 12, first cylinder 18 is operated to move guide strip 12 over a considerable distance, as illustrated in FIG. 3. Carriage 2 with its chuck 3 can then be positioned relatively close to the bending tool, without encountering interference from the guide strip 12 to permit further bending of the pipe 4 at points adjacent to its end gripped by the carriage 2 while said guide strip 12 is spaced laterally from said pipe 4 by a relatively long distance by first cylinder 18 as shown in FIG. 3.

The program controlling the movements of the machine automatically determines the intervention of first cylinder 18 or of second cylinder 23, as a function of the position of carriage 2.

Adjustment means 29 to 35 make it possible to correct the position of guide strip 12, relative to pipe 4, particularly to compensate for possible differences in thickness of this guide strip 12. By crank 29 being turned in one direction or the other, screw 30 is moved relative to piston 22 of second cylinder 23, and thus the initial position of first cylinder 18, support 14 and guide strip 12 can be offset slightly. It is understood that this adjustment does not influence movement distance C of second cylinder 23.

In the entire preceding description, only the transverse movement of guide strip 12, with which this invention is directly concerned, has been considered. It should be noted that this invention is also applicable both to a machine with a guide strip mobile only transversely and to a machine with a guide strip that can be moved transversely and also longitudinally to accompany the pipe in its advance during bending, thanks to an additional longitudinal slide 36 (see FIG. 4).

Of course, and as comes out from the above, the invention is not limited to the sole embodiment of this guide strip control device of a pipe bending machine which has been described above, by way of example; rather, it takes in all variant embodiments and applications that respect the same principle.

What is claimed is:

1. A guide strip control device for controlling a one piece guide strip in a pipe bending machine, said guide strip being positioned laterally against a pipe in a location behind a portion of the pipe to be bent by a bending die, the pipe being held and moved along a longitudinal axis by a carriage comprising:

first means for controlling movement of the one piece guide strip transverse to the longitudinal axis of the pipe to be bent over a first relatively long distance sufficient to disengage the pipe entirely from a gripping position and to allow movement and positioning of the carriage; relatively close to the bend die without interference from said guide strip to permit further bending of the pipe adjacent to an end of said pipe gripped by said carriage while said guide strip is spaced laterally from said pipe by said long distance; and second means for controlling movement of the one piece guide strip transverse to the longitudinal axis of the pipe to be bent over a second relatively short distance so that the pipe is freed laterally but remains supported by a portion of the guide strip, said second means being distinct from said first means.

2. The guide strip control device of a pipe bending machine according to claim 1, wherein said first means to move guide strip over a relatively long distance consists of a first cylinder, and said second means to move guide strip a relatively short distance consists of a second cylinder, the two cylinders being mounted so that their center lines are coaxial, with their movements being controlled independently of one another.

3. The guide strip control device of a pipe bending machine according to claim 2, wherein said first cylinder moves a relatively long distance and connects a support of the guide strip, which is mounted to slide on a guide means carried by a machine frame, and wherein a piston of said second cylinder moves a relatively short distance; said second piston having a body fastened to the machine frame.

4. The guide strip control device of a pipe bending machine according to claim 3, further comprising means for manual adjustment of said first cylinder relative to the piston of said second cylinder along their coaxial center lines.

5. The guide strip control device of a pipe bending machine according to claim 4, wherein said adjustment means comprises an adjusting screw, mounted to turn freely in the piston of said second cylinder along an axis of said second cylinder and connected to crank means, said adjusting screw being threadably mounted in a tapped sleeve mounted to slide in the axial direction of the piston of said second cylinder but fixed against rotation, said sleeve being fastened to one end of a rod of said first cylinder.

* * * * *